US006913170B2

(12) United States Patent
Naveau

(10) Patent No.: US 6,913,170 B2
(45) Date of Patent: Jul. 5, 2005

(54) METHOD AND DEVICE FOR CONTINUOUS CASTING OF LIQUID STEEL

(75) Inventor: Paul Naveau, Alleur (BE)

(73) Assignee: Centre de Recherches Metallurgiques A.S.B.L., Brussels (BE)

( * ) Notice: Subject to any disclaimer, the term of this patent is extended or adjusted under 35 U.S.C. 154(b) by 177 days.

(21) Appl. No.: 10/362,356

(22) PCT Filed: Sep. 18, 2001

(86) PCT No.: PCT/BE01/00158

§ 371 (c)(1),
(2), (4) Date: Feb. 27, 2003

(87) PCT Pub. No.: WO02/30598

PCT Pub. Date: Apr. 18, 2002

(65) Prior Publication Data

US 2003/0173721 A1 Sep. 18, 2003

(30) Foreign Application Priority Data

Oct. 10, 2000 (BE) ..... 2000/0643

(51) Int. Cl.[7] ..... B22D 35/00
(52) U.S. Cl. ..... 222/606; 222/594; 164/437
(58) Field of Search ..... 222/591, 594, 222/606, 592; 164/437, 487, 488

(56) References Cited

U.S. PATENT DOCUMENTS 3,530,929 A * 9/1970 Harders et al. ..... 164/437
4,874,471 A * 10/1989 Wilmotte ..... 164/437
4,995,446 A * 2/1991 Naveau et al. ..... 222/592

FOREIGN PATENT DOCUMENTS

| | | |
|---|---|---|
| BE | 1012037 | 4/2000 |
| EP | 0327526 | 8/1989 |
| EP | 0455619 | 11/1991 |
| LU | 86688 | 6/1988 |
| LU | 86739 | 8/1988 |

* cited by examiner

*Primary Examiner*—Scott Kastler
(74) *Attorney, Agent, or Firm*—Jacobson Holman PLLC

(57) ABSTRACT

The invention concerns a nozzle mainly consisting, when viewed in vertical position and in a forward movement of the liquid steel from the top downwards, of a vertical conduit (5) comprising in its upper part a distributing member, arranged substantially at the intake of said conduit and including a dome (6) for deflecting the metal penetrating into the nozzle, which is also provided with means for injecting a gaseous, liquid or solid finely divided material beneath said dome (6) into an inner zone (11). The dome (6) of said distributing member is provided with means for separating liquid steel into two jets (B, C), one jet (B) flowing into the inner zone (11) and penetrating into the ingot mould (1) through a first orifice (9) at the lower base of said conduit (5) and the other jet (C) flowing into an outer zone (12) and penetrating into the ingot mould (1) through lateral orifices (8) located in the vertical wall of said conduit (5).

15 Claims, 1 Drawing Sheet

METHOD AND DEVICE FOR CONTINUOUS CASTING OF LIQUID STEEL

This is a nationalization of PCT/BE01/00158, filed Sep. 18, 2001 and published in French.

BACKGROUND OF THE INVENTION

1. Field of the Invention

The present invention relates to a new device for the continuous casting of steel to obtain an end product with a mixed chemical composition, i.e. including, on one hand, the base steel and, on the other hand, the base steel alloyed with elements added during casting.

The invention also relates to a method implemented by the device.

2. Description of the Prior Art

The continuous casting technique for steel is well known. It essentially consists in supplying molten steel from a tundish into a cooled mould made of copper or of a copper alloy, referred to as a continuous casting mould, the latter having a opening at its lower end, and in extracting from it a continuous and partially solidified ingot through this opening.

In general, the molten steel is introduced into the casting mould by means of at least one nozzle, i.e. a generally tubular element arranged between the tundish and the casting mould. The lower end of the nozzle is usually provided with one or two outlet orifices located in the axis of the nozzle or laterally. The lower end of the nozzle emerges below the top level of liquid steel present in the casting mould.

The prior art also includes nozzles intended to ensure better cooling of the superheated liquid steel coming from the tundish. The purpose is to obtain pasty steel at the inlet of the casting mould. In particular, these nozzles may have a heat exchanger formed by a water-cooled copper tube or even a deflector or dome. The purpose of the latter is to force the superheated steel to trickle along the walls of the nozzle in a thin layer in order to increase the surface area for heat exchange. This technique is referred to as "hollowjet casting".

Moreover, it is common practice to inject inert gas, such as argon, at the level of inlet of the molten steel in the nozzle with in order to avoiding steel oxidation and preventing accidental blockage, especially through the formation of alumina. The technique of hollow-jet casting allows, in particular, reducing the risk of blockage of the gas supply compared with the case where the inlet orifice of the latter is in direct contact with the liquid steel introduced into the nozzle. Thus, one known technique is to inject the inert gas, such as argon, inside the hollow jet. It is also possible to inject a certain amount of finely divided material into the hollow jet using a non-oxidising gas under a pressure slightly above atmospheric pressure as a vector in order to prevent any entry of air. This material is an alloying metal or a ceramic, for example. The purpose is to obtain a metallic alloy or a composite, depending on the case.

Nowadays, continuous casting of products based on steel with a mixed or bi-component chemical composition has raised a lot of interests in a significant number of specific applications, both for long and flat products. The term bi-component refers to products in which the chemical composition of the steel differs depending on the location in the product that is investigated. For Example, the composition can be different in the skin as compared with the core of the product.

In particular, such a technique can be used, for example:

- to increase the quality of the surface treatment of the products. In the case of galvanisation, for example, it is desirable to reduce the silicon content in the vicinity of the slab surface in order to improve the suitability of the rolled products for galvanisation;
- to enhance castability, for example, in the case of peritectic steels, whose carbon content is in the order of 0.1–0.15% and which are particularly difficult to cast, when modification of the carbon content in the vicinity of the surface is desired;
- to cast products whose mechanical properties vary according to thickness, such as a high strength at the surface and high ductility at the core, for instance.

Processes to obtain metal parts, in particular, steel parts with a mixed chemical composition, such as rolling cylinders, wearing parts, etc., are known in the field of casting.

However, the prior art does not include a simple device to obtain mixed-composition steels by continuous casting. The use of at least two tundishes in parallel, each provided with its own nozzle and acting simultaneously to cast mixed-composition steels into the same casting mould, is known. However, such an arrangement proves very complex and very costly on an industrial scale. Another way of obtaining a bi-component steel, for example, by introducing a metal sheet into the ingot during casting, has been envisioned. But this again proves to be not very practical.

SUMMARY OF THE INVENTION

One object of the present invention is to provide a device and an associated method for the continuous casting of steel in order to obtain products of mixed chemical composition, without the disadvantages of the prior art.

In particular, the invention proposes a new process allowing the use of an existing continuous casting installation with one single specific nozzle.

The present invention relates to a continuous casting nozzle intended for the steel flow from a tundish into a casting mould; said nozzle, if described in a vertical position and considered in a forward movement of the liquid steel from the top downwards, comprising a vertical conduit including an upper base at an upper end having an inlet orifice for the liquid steel from the tundish and a lower base at a lower end having at least one outlet orifice; said conduit comprising, in its upper part, a distributing member arranged substantially at the inlet orifice of said vertical conduit and comprising a dome to deflect the metal entering the nozzle; said nozzle likewise comprising means for injecting a gaseous, liquid or finely divided solid material under said dome into an inner zone; characterised in that the dome of said distributing member is provided with means for separating the liquid steel into two jets, which separately enter the casting mould.

The dome of said distributing member advantageously has at least four passages, which are interconnected in such a way as to divide the flow of the molten steel into two separate jets respectively flowing through a zone referred to as inner zone and a zone referred to as outer zone towards the casting mould.

The outer zone preferably emerges towards the casting mould by means of at least two lateral orifices, and the inner zone emerges towards the casting mould by means of at least one first orifice.

According to a first embodiment of the invention, the liquid metal passing under the dome in the zone in which gaseous, liquid or finely divided solid material is injected, is channelled into the inner zone and flows into the casting mould through the first orifice or orifices.

According to a second embodiment of the invention, the liquid metal passing under the dome in the zone in which gaseous, liquid or finely divided solid material is injected, is channelled into the outer zone and flows into the casting mould through the lateral orifices.

A preferred embodiment of the invention relates to a nozzle intended for the steel flow from a tundish into a casting mould. If described in a vertical position and considered in a forward movement of the liquid steel from the top downwards, the nozzle principally comprises a vertical conduit including an upper base at an upper end having an inlet orifice for receiving the liquid steel from the tundish and a lower base at a lower end having a first outlet orifice. Moreover, the conduit has, in its upper part, a distributing member arranged substantially at the inlet of said vertical conduit and comprising a dome to deflect the metal entering the nozzle with a vertical wall connecting a bottom of the dome and extending as far as the lower base of said conduit, said vertical wall having at least two lateral outlet orifices, the distributing member dividing the vertical conduit into two physically separated zones, a zone referred to as an inner zone and a zone referred to as an outer zone. The nozzle likewise comprises means for injecting a gaseous, liquid or finely divided solid material under said dome into the inner zone. The nozzle is characterised by the fact that the dome of said distributing member is provided with means for separating the liquid steel into two jets, a jet flowing into the inner zone and entering the casting mould through said first orifice and a jet flowing into the outer zone and entering the casting mould through the lateral orifices.

The vertical conduit is preferably cylindrical in shape and has a circular or oval cross-section.

In addition, in accordance with the invention, the liquid metal forming the jet into which an injection is performed under the dome consists of a mixture of base steel and the material injected under the dome. Moreover, the chemical composition of the metal obtained after having performed an injection under the dome is different from the chemical composition of the base steel.

The finely divided solid material injected under the dome is advantageously in suspension in a non-oxidising gas.

The finely divided solid material injected under the dome advantageously has a particle size of less than 2000 $\mu$m.

The particle size of said finely divided material is particularly advantageously between 100 and 300 $\mu$m.

According to a particular embodiment, the two jets have different flow rates.

According to the present invention, the flow rate of the liquid metal cast for flat products is between 1.5 and 6 tonnes per minute. The flow rate for long products is between 0.3 and 0.5 tonne per minute.

The vertical conduit is advantageously provided with means for regulating the temperature of the liquid metal flowing through said conduit. However, according to the invention, the means for regulating the temperature of the liquid metal flowing in the part ahead of the distributing member comprising the dome are distinct from the means for regulating the temperature of the liquid metal flowing in the part after the above-mentioned dome.

In operation, the nozzle of the invention is part of an installation for the continuous casting of steel, preferably in the form of long or flat products, comprising a tundish provided with an outlet orifice and a flow-regulating device, and a casting mould. The nozzle thus allows casting a steel of mixed composition in the casting mould, starting from the molten base steel in the tundish.

Another aspect of the present invention relates to a new process for the continuous casting of steel, preferably in the form of long or flat products, comprising the following stages:

- casting a molten base steel from a tundish through an outlet orifice provided with a flow-regulating element into a nozzle comprising a distributing member having a dome and a vertical wall dividing the nozzle into an inner zone and an outer zone;
- separating the base steel in the distributing member into an inner jet flowing through the inner zone and an outer jet flowing through the outer zone;
- injecting a gaseous, liquid or finely divided solid material under said dome into the inner zone and mixing of said material with the base steel of the inner jet in order to form a steel with a different chemical composition from the base steel;
- flowing the outer jet of base steel through lateral apertures in the nozzle and solidifying said jet along the walls of the casting mould;
- flowing the inner jet of steel of different chemical composition through a lower aperture in the nozzle and solidifying the jet of steel of different chemical composition in the center of the casting mould.

The present invention has the following advantages over the prior art:

- a steel of mixed chemical composition is obtained by continuous casting, using one single nozzle that is compatible with the casting installation;
- simplification compared with a complicated and therefore very costly installation, which is, however, theoretically feasible on an industrial scale, comprising at least two nozzles and/or two tundishes;
- feasibility of continuous casting of a range of steel-manufacturing or metallurgical products, referred to as products of high added value, such as coated products (galvanised, plastic-coated, etc.).

DESCRIPTION OF A PREFERRED EMBODIMENT OF THE INVENTION

Figure 1:
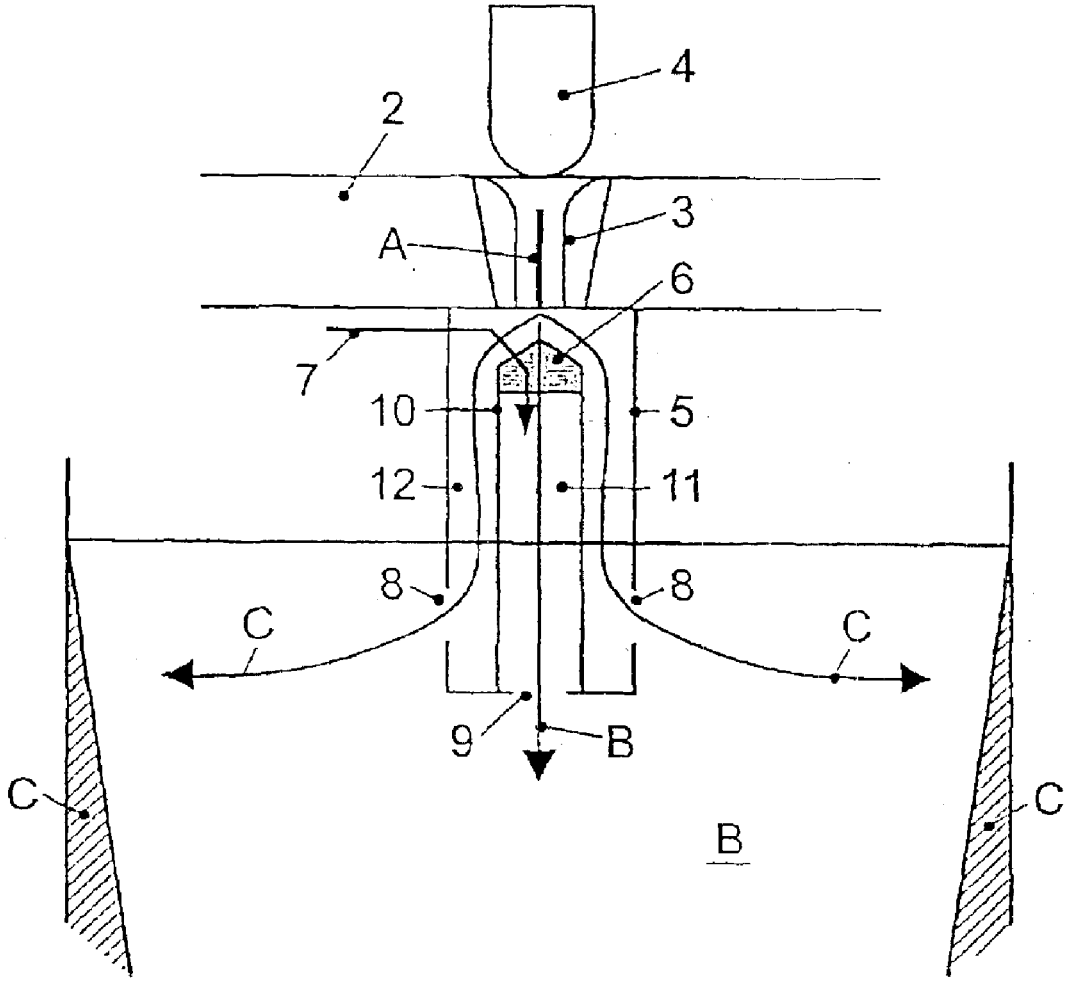
FIG. 1 is a schematic elevation view of an installation for the continuous casting of steel using a nozzle according to the present invention.

FIG. 1 shows a casting device according to a particular form of the invention, mounted between a continuous casting mould 1 and a casting ladle or tundish 2 having an outlet conduit 3. The outlet conduit 3 is provided with a flow regulator such as a stopper 4 or a slide gate. A nozzle 5, essentially cylindrical in shape and possibly of oval cross-section, fixed on the tundish, is mounted on the casting mould 1. The nozzle 5 can, for example, be provided with a copper heat exchanger provided with a water-cooling system. The upper base of the cylinder is in contact with the conduit 3. This base is provided with an orifice corresponding to the lower orifice of the conduit. In its lower part, the nozzle 5 has three communication apertures allowing the steel to pass towards the casting mould: two lateral apertures 8 and an aperture 9 located in the lower base of the conduit 5. At the upper end of the nozzle 5, a distributing member in the form of a dome 6 is arranged. The upper surface of said dome slightly slopes, preferably at an angle greater than 10° relative to the horizontal. The dome 6 is fixed to the conduit 5 by means that are not shown. An injection device 7 is located in such a way as to introduce a gas, a liquid or finely divided or powdered solid particles under the dome 6, possibly using a non-oxidising gas as a vector in the latter case. The dome 6 has a lateral wall 10, preferably vertical and cylindrical, extending as far as the bottom of the nozzle 5. This lateral wall can isolate a part referred to as the inner part 11 of the conduit 5 from another part, referred to as the outer part 12, of the same conduit 5.

Figure 2:
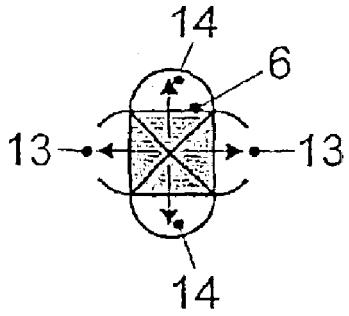
FIG. 2 is a schematic plan view of a casting tundish incorporated into a nozzle according to the present invention.

FIG. 2 shows one embodiment of a distribution dome 6 comprising four passages for the molten metal communicating in pairs, in a highly schematized form in plan view. Each of the four passages is associated with one opening in the dome 6. Two openings 13 are delimited by cutting the dome between the latter and the inner wall of the nozzle 5. The two other openings 14 are made more towards the centre of the surface of the dome 6, for example, and communicate underneath this surface through a common collection tube 11 which itself emerges downstream of the nozzle. Thus, the dome 6 can separate the jet of metal A coming from the tundish 2 through the conduit 3 into two distinct jets of substantially equal size and physically separated from each other: a first jet of metal B, which flows through the centre 11 of the nozzle 5, and a second jet of metal C, which flows through the space 12, possibly along the inner lateral wall of the conduit 5 (FIG. 1).

The injection device 7 can be used to introduce an additional constituent, such as an alloying metal, a gas or a ceramic, into the jet of metal B and thus to modify its composition relative to the base metal. The metal B flows out of the nozzle 5 into the central part of the casting mould 1 through the aperture 9. The metal C flows out of the nozzle 5 through the lateral apertures 8. When it solidifies, the metal C will be distributed over the walls of the casting mould, while the metal B, which is of modified chemical composition, will be more towards the core in the solidified mass.

The material injected by the device 7 under the dome 6 can be in the gaseous, liquid or solid phase. In the latter case, the material is in the form of powder or finely divided particles. The size of the particles injected is less than 2 mm and is more often between 100 and 300 $\mu$m.

The process according to the invention can be used both in continuous casting of flat products, such as slabs, and in that of long products, such as round, square or wire products, etc.

In particular, in the case of flat products, the variation in chemical composition obtained on the cross-section of the product can be preserved during direct rolling. Such steels are consequently ideally for galvanisation, owing to the fact, for example, that the outer layer is of modified composition compared with the core of the product and promotes easy binding of the coating layer of zinc, in particular owing to the reduction in the skin of the silicon concentration. In the case of long products, the steel can contain copper (CORTEN steel), for example, in a continuous manner in order to avoid the problems of surface corrosion. It is thus possible to dispense with stainless steel, which is very expensive. In the process according to the invention, the flow rates of steel in the casting mould correspond to the industrial standards that are the norm in metallurgy. In particular, the flow rate is between 1.5 and 6 tonnes/min. for flat products and between 0.3 and 0.5 tonne/min. for long products.

What is claimed is:

1. A continuous casting nozzle for the flow of steel from a tundish into a casting mould; said nozzle, if described in a vertical position and considered in a forward movement of the liquid steel from the top downwards, comprising a vertical conduit including an upper base at an upper end having an inlet orifice for receiving the liquid steel from the tundish and a lower base at a lower end having at least one outlet orifice; said conduit comprising, in its upper part, a distributing member arranged substantially at the inlet of said vertical conduit and comprising a dome to deflect the liquid steel entering the nozzle; said nozzle further comprising means for injecting a gaseous, liquid or finely divided solid material under said dome into an inner zone within said conduit; characterised in that the dome of said distributing member is provided with means for separating the liquid steel into two jets, which separately enter the casting mould.

2. The nozzle according to claim 1, characterised in that the dome of said distributing member has at least four passages and in that said passages are interconnected in such a way as to divide the flow of the liquid steel into two separate jets, respectively, flowing through the inner zone to be mixed with the material injected under the dome and an outer zone towards the casting mould.

3. The nozzle according to claim 1, characterised in that the outer zone emerges towards the casting mould by means of at least two lateral orifices, and in that the inner zone emerges towards the casting mould by means of at least one orifice.

4. The nozzle according to claim 3, characterised in that the liquid steel passing under the dome in the zone in which gaseous, liquid or finely divided solid material is injected, is channelled into the inner zone and flows into the casting mould through said at least one orifice.

5. The nozzle according to claim 3, characterised in that the liquid steel passing under the dome in the zone in which gaseous, liquid or finely divided solid material is injected, is channelled into the outer zone and flows into the casting mould through said at least one orifice.

6. The nozzle according to claim 1, for the flow of steel from a tundish into a casting mould; said nozzle, if described in a vertical position and considered in a forward movement of the liquid steel from the top downwards, comprising a vertical conduit including an upper base at an upper end having an inlet orifice for receiving the liquid steel from the tundish and a lower base at a lower end having a first outlet orifice; said conduit having, in its upper part, a distributing member arranged substantially at the inlet of said vertical conduit and comprising a dome to deflect the liquid steel entering the nozzle with a vertical wall connecting a bottom of the dome and extending as far as the lower base of said conduit, said vertical wall having at least two lateral outlet orifices, the distributing member dividing the vertical conduit into two physically separated zones, an inner zone and an outer zone; said nozzle further comprising means for injecting a gaseous, liquid or finely divided solid material under said dome into the inner zone; characterised in that the dome of said distributing member is provided with means for separating the liquid steel into two jets, a first jet flowing into the inner zone and entering the casting mould through said first orifice and a second jet flowing into the outer zone and entering the casting mould through the lateral orifices.

7. The nozzle according to claim 1, characterised in that the vertical conduit is cylindrical in shape and has a circular or oval cross-section.

8. The nozzle according to claim 1, characterised in that it comprises means for enabling said finely divided solid material injected under the dome to be in suspension in a non-oxidising gas.

9. The nozzle according to claim 1, characterised in that it is conformed so that a finely divided solid material with a particle size of less than 2000 $\mu$m can be injected under the dome.

10. The nozzle according to claim 9, characterised in that the particle size of said finely divided material is between 100 and 300 $\mu$m.

11. The nozzle according to claim 1, characterised in that it is configured so that the two jets have different flow rates.

12. The nozzle according to claim 1, characterised in that the vertical conduit is provided with means for regulating the temperature of the liquid steel flowing through said conduit, comprising a first means for regulating the temperature of the liquid steel flowing in the part ahead of the distributing member comprising the dome and a second means for regulating the temperature of the liquid steel flowing in the part after said dome.

13. The nozzle according to claim 12, characterised in that said first means and said second means for regulating the temperature are different.

14. An installation for the continuous casting of steel, comprising a tundish provided with an outlet orifice and a flow-regulating device, a casting mould and a nozzle according to claim 1, said nozzle enabling a steel of mixed composition to be cast in the casting mould, starting from a molten base steel in the tundish.

15. A method for the continuous casting of steel, comprising the following steps:

casting molten base steel from a tundish through an outlet orifice provided with a flow-regulating element in a nozzle comprising a distributing member having a dome and a vertical wall dividing the nozzle into an inner zone and an outer zone;

separating the base steel in the distributing member into an inner jet flowing through the inner zone and an outer jet flowing through the outer zone;

injecting a gaseous, liquid or finely divided solid material under said dome into the inner zone and mixing said material with the base steel of the inner jet in order to form a steel of different chemical composition from the base steel;

flowing the outer jet of base steel through lateral apertures in the nozzle and solidifing said jet along the walls of the casting mould; and flowing the inner jet of steel of different chemical composition through a lower aperture in the nozzle and solidifying the inner jet in center of the casting mould.

* * * * *